United States Patent [19]

Fuerneisen

[11] 4,310,908

[45] Jan. 12, 1982

[54] ADHESIVELY ATTACHABLE TIMEPIECE

[75] Inventor: Thomas J. Fuerneisen, Carefree, Ariz.

[73] Assignee: Microtime Incorporated, Scottsdale, Ariz.

[21] Appl. No.: 143,824

[22] Filed: Apr. 25, 1980

[51] Int. Cl.[3] ..... G04C 23/02; G04B 37/00

[52] U.S. Cl. ..... 368/88; 368/277

[58] Field of Search ..... 368/88, 278, 316–317, 368/277, 280–283, 299–301

[56] References Cited

U.S. PATENT DOCUMENTS

| | | | |
|---|---|---|---|
| 2,814,927 | 12/1957 | Steimason | 368/317 |
| 3,807,236 | 4/1974 | Leone | 368/316 |
| 4,075,829 | 2/1978 | Goff | 368/316 |
| 4,236,239 | 7/1980 | Imgruth et al. | 368/88 X |

FOREIGN PATENT DOCUMENTS

| | | | |
|---|---|---|---|
| 2124861 | 11/1972 | Fed. Rep. of Germany | 368/316 |
| 1342899 | 10/1963 | France | 368/317 |

*Primary Examiner*—Vit W. Miska

*Attorney, Agent, or Firm*—Cahill, Sutton & Thomas

[57] ABSTRACT

A timepiece module having a liquid crystal display read-out is supported on one face of a rectangular face plate, the read-out being visible from an opposite face of the face plate through an aperture therein. A mounting clip for supporting the face plate includes first and second flanges for engaging opposed edges of the face plate. An adhesive element attached to an outer surface of the support clip permits the mounting clip and timepiece module supported thereby to be attached to any smooth object surface.

6 Claims, 3 Drawing Figures

ADHESIVELY ATTACHABLE TIMEPIECE

BACKGROUND OF THE INVENTION

1. Field of the Invention

The invention relates to timepieces and, more particularly, to small timepieces which are adhesively attachable to smooth object surfaces.

2. Description of the Prior Art

Solid state liquid crystal display watch modules are readily available from various semiconductor manufacturers. Such clock modules are ordinarily utilized in conventional wristwatches. However, such watch modules have also been utilized to manufacture small desk clocks by attaching each watch module to the inside of a shallow "can" or cover and supporting the can on a piece of plastic which is to provide an attractive support for the cover of the watch module. There are numerous devices, such as pieces of machinery, whereon it would be convenient to have a low-cost timepiece installed if there existed an inexpensive timepiece which could be easily installed on such devices. It would also be desirable to install timepieces on various walls and other objects if sufficiently inexpensive and easily installed timepieces were available.

Accordingly, it is an object of the invention to provide a very inexpensive timepiece which can be easily installed on an object surface.

It is another object of the invention to provide an inexpensive timepiece which can be easily adhesively attached to any smooth surface, which timepiece does not require an external power means.

SUMMARY OF THE INVENTION

Briefly described, and in accordance with one embodiment thereof, the invention provides a timepiece including a solid state watch module having a digital display, a face plate supporting the watch module, and a mounting clip for attachment to an object surface. The face plate is removably engaged by the mounting clip. The mounting clip includes a pair of opposed, parallel flanges for slidably receiving opposed parallel edges of the face plate. The flanges extend perpendicularly from opposite ends of a rigid web member. The body of the watch module is disposed between the face plate and an inner surface of the web member. The digital display of the watch module is visable through an aperture in the face plate. An adhesive substance is disposed for attaching an outer back surface of the web member to permit attaching of the timepiece to a smooth object surface on which the timepiece is to be installed. The face plate can be easily removed from the mounting clip to facilitate resetting the watch module or replacing batteries thereof by simply sliding the face plate sideways out of the mounting clip. A can or cover then can be removed to allow replacement of batteries powering the watch module or to allow setting the time of the watch module. In one embodiment of the invention, the adhesive is replaced by or incorporated with a small permanent magnet attached to the back side of the mounting clip, allowing the timepiece to be magnetically mounted on any ferro-magnetic object surface.

DESCRIPTION OF THE INVENTION

Figure 1:
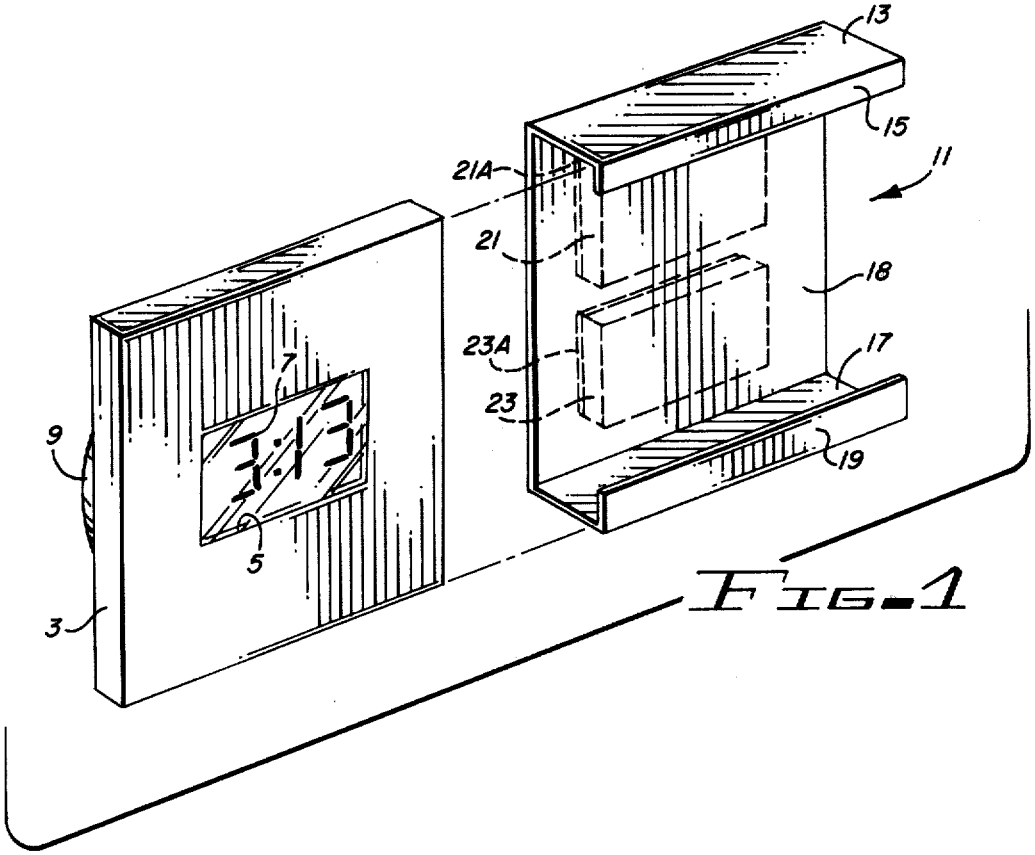
FIG. 1 is an exploded perspective view of the timepiece of the present invention.
Figure 2:
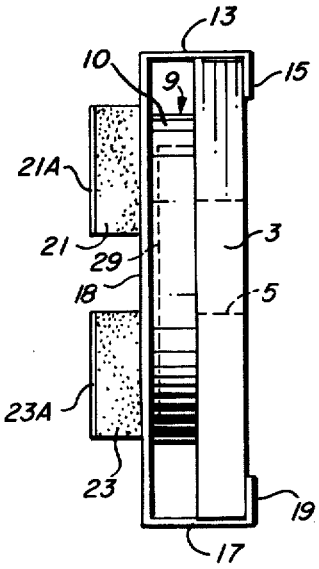
FIG. 2 is a side view of the timepiece shown in FIG. 1.

Referring now to the drawings, timepiece 11 includes a support plate 3 having a generally rectangular configuration. Support plate 3 preferably is composed of suitable plastic. A rectangular aperture 5 is centrally disposed through plate 3. A solid state watch module 9 having a digital display including characters such as character 7 is attached to the back plate of support plate 3. Support plate 3 is approximately two inches square.

Timepiece 11 also includes a mounting clip for supporting plate 3. The support clip includes a rigid connecting web 18 having a generally rectangular configuration. An upper flange 13 extends forward from the upper edge of web 18. Upper flange 13 is generally rectangular, and lies in a plane perpendicular to the plane of web 18. A narrow lip 15 extends downward from the front edge of flange 13. A lower flange 17 extends forward from the lower edge of web 18 and lies in a plane parallel to the plane of upper web 13. A narrow lip 19 extends upward from the front edge of lower flange 17.

Preferably, web 18, upper flange 13, lower flange 17, and lips 15 and 19 are of unitary construction, and are formed from a single, thin rectangular strip of aluminum or stainless steel, although other materials can be used. The distance between the inner surfaces of flanges 13 and 17 is slightly less than the distance between the upper and lower edges of support plate 3. The material of which the mounting clip is formed is slightly resilient so that plate 3 is snugly held in place between upper and lower flanges 13 and 17, but can be easily slid sideways into or out of the mounting clip in order to allow convenient replacement of batteries and watch module 9 or to allow resetting thereof.

The distance between the inner surfaces of lips 15 and 19 are each approximately equal to the thickness of support plate 3 and the distance through which watch module 9 extends from the rear surface of support plate 3.

First and second adhesive attachment elements 21 and 23 are affixed to the rear surface of rigid web 18. Attachment elements 21 and 23 each include a thin strip of resilient rubber or plastic foam material. Each such strip includes a layer of adhesive material on the rear surface thereof. A pair of "peel-off" protective shields 21A and 23A are removably disposed on the layers of adhesive material. Peel-off shields 21A and 23A can be removed to expose the adhesive material, so that the adhesive surfaces of attachment elements 21 and 23 can be pressed against any smooth object surface, thereby semi-permanently attaching timepiece 11 thereto.

The watch module 9 includes a metal can or cover 10 and a commercially available electronic timepiece component 29 disposed inside cover 10. Watch module 9 snugly fits in a metal receiving sleeve 33, which is rigidly attached to the rear surface of support plate 3. Metal receiving sleeve 33 effects reliable insertion and removal of watch module 9 from support plate 3. A user can set the time of watch module by pulling cover 10 out of receiving sleeve 31, whereby the electronic timepiece component 29 is exposed and accessible through the open end of cover 10. The user than can easily set the time or replace batteries of the device. Suitable electronic timepiece components 29 such as can be readily obtained from various semiconductor manufacturers, such as Motorola, National Semiconductor, Inc. and others.

Figure 3:
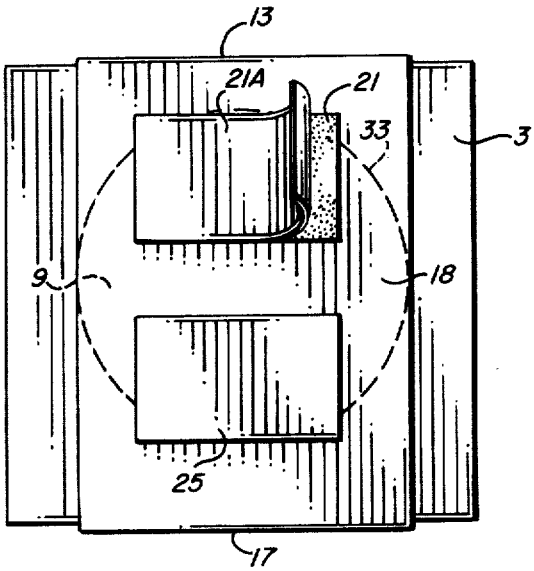
FIG. 3 is a back view of the timepiece shown in FIG. 1.

In an alternative embodiment of the invention, either one or both of the attachment elements 21 can be a magnet instead of the above-mentioned foam strip with adhesive thereon. For example, in FIG. 3, an adhesive attachment element 21 is shown disposed on the back of rigid web 18, a permanent magnet 25 being utilized to implement the lower attachment element. This particular "universal" configuration can be utilized to attach timepiece 11 to either a smooth object surface or to a ferro-magnetic object surface, even one which is not sufficiently smooth to allow adhesive attachment thereto.

While the invention has been described with reference to a particular embodiment thereof, those skilled in the art will be able to make various modifications to the described embodiment of the invention without departing from the true spirit and scope thereof as set forth in the appended claims.

I claim:

1. An electronic timepiece comprising in combination;

(a) a solid state electronic timepiece component having a digital display element;

(b) enclosure means for partially enclosing said solid state electronic timepiece component, said enclosure means having a back wall and a side wall attached to said back wall, said solid state electronic timepiece being rigidly attached to an inner surface of said back wall, said side wall surrounding said solid state electronic timepiece component;

(c) support plate means for supporting said enclosure means with said solid state electronic timepiece component attached thereto, said support plate means having substantially parallel front and rear major surfaces, said support plate means having a viewing aperture therein for exposing said digital display element to allow viewing of said digital display element, said support plate means having substantially parallel upper and lower edges, said support plate means having enclosure receiving means for removably receiving said enclosure means and rigidly supporting said enclosure means so that said digital display element is properly aligned with said viewing aperture;

(d) mounting clip means for receiving and removably supporting said support plate means as said support plate means rigidly supports said enclosure means and said solid state timepiece component, said mounting clip means including a back plate and upper and lower edge engaging means attached to said back plate for slideably engaging said upper and lower edges of said support plate means to effect rigid, removable engagement of said support plate means with said mounting clip means as said support plate means rigidly supports said enclosure means; and (e) adhesive means attached to a rear surface of said back plate of said mounting clip means for adhesively attaching said electronic timepiece to a smooth object surface, said upper and lower edge receiving means maintaining said solid state electronic timepiece component in fixed relationship with said smooth object surface.

2. The timepiece of claim 1 wherein said adhesive means includes a piece of resilient support material attached to said back surface, a layer of adhesive material disposed on an exposed surface of said piece of resilient support material, and a peel-off shield disposed on said layer of adhesive material.

3. The timepiece of claim 1 wherein said adhesive means includes a magnet.

4. The electronic timepiece of claim 1 wherein said enclosure means includes a shallow, cylindrical can-like container having a circular bottom, a back surface of said solid state electronic timepiece component being rigidly attached to an outer circular bottom surface of said can-like container, wherein said enclosure receiving means includes a cylindrical sleeve means rigidly attached to said rear major surface of said support state means, said cylindrical sleeve means receiving the cylindrical wall of said shallow, cylindrical can-like container in telescoping relationship therewith.

5. The electronic timepiece of claim 4 wherein said mounting clip means is of unitary construction, said upper edge receiving means including a first flange extending perpendicularly from an inner surface of said back plate, a first retaining lip extending downward from a free edge of said first flange, said lower edge receiving means including a second flange parallel to said first flange and a second lip extending upwardly from a free edge of said second flange, said first and second lips engaging said upper and lower edges of said support plate means, respectively & resiliently forcing said support plate means toward said back plate of said mounting clip means so that an outer surface of said circular can-like container engages an inner surface of said back plate of said mounting clip means.

6. An electronic timepiece comprising in combination;

(a) a solid state electronic timepiece component having a digital display element;

(b) enclosure means for partially enclosing said solid state electronic timepiece componet, said enclosure means having a back wall and a side wall attached to said back wall, said solid state electronic timepiece being rigidly attached to an inner surface of said back wall, said side wall surrounding said solid state electronic timepiece component;

(c) support plate means for supporting said enclosure means with said solid state electronic timepiece component attached thereto, said support plate means having substantially parallel front and rear major surfaces, said support plate means having a viewing apperture therein for exposing said digital display element to allow viewing of said digital display element, said support plate means having substantially parallel upper and lower edges, said support plate means having enclosure receiving means for removably receiving said enclosure means and rigidly supporting said enclosure means so that said digital display element is properly aligned with said viewing aperture;

(d) mounting clip means for receiving and removably supporting said support plate means as said support plate means rigidly supports said enclosure means and said solid state timepiece component, said mounting clip means including a back plate and upper and lower edge engaging means attached to said back plate for slideably engaging said upper and lower edges of said support plate means to effect rigid, removable engagement of said support plate means with said mounting clip means as said support plate means rigidly supports said enclosure means; and (e) magnetic means attached to a rear surface of said back plate of said mounting clip means for magnetically attaching said electronic timepiece to a smooth object surface, said upper and lower edge receiving means maintaining said solid state electronic timepiece component in fixed relationship with said smooth object surface.

* * * * *